United States Patent [19]

Henson

[11] Patent Number: 4,821,458

[45] Date of Patent: Apr. 18, 1989

[54] COMBINE BLADE SHARPENING APPARATUS

[76] Inventor: Randy J. Henson, Rte. 1, Box 195, Wheeler, Tex. 79096

[21] Appl. No.: 76,769

[22] Filed: Jul. 23, 1987

[51] Int. Cl.[4] ..... B24B 7/00

[52] U.S. Cl. ..... 51/98 BS; 51/98 HK; 76/89.1

[58] Field of Search ..... 51/98 HR, 82 R, 82 BS, 51/98 BS, 98 R, 92 BS, 92 HK, 92 ND, 206 R, 206 P, 285, 36, 231; 30/346.61, 351; 76/89.1, DIG. 8, DIG. 9

[56] References Cited

U.S. PATENT DOCUMENTS 342,789 6/1886 Fenton ..... 51/98 HK 1,667,064 4/1928 Yerkey ..... 51/92 ND

*Primary Examiner*—Frederick R. Schmidt

*Assistant Examiner*—Maurina Rachuba

*Attorney, Agent, or Firm*—Laney, Dougherty, Hessin & Beavers

[57] ABSTRACT

A sharpening apparatus for sharpening the cutting edges of combine blades. The apparatus includes a base with a table adjustably positioned thereon. The table may be moved transversely and longitudinally with respect to the base. A combine blade assembly may be clamped to the table, and the table has a V-notch in one side thereof which is aligned with opposite cutting edges of a pair of adjacent blades. A plurality of progressively larger cutting wheels are mounted to the shaft of an electric motor. The electric motor may be pivoted with respect to the table between a cutting position in which the cutting wheels engage the opposite edges of the adjacent blades and a free position spaced therefrom. The cutting wheels cut a plurality of spaced, transverse slots in the edges of the adjacent blades. The slots provide new cutting surfaces for cutting grain when the blade assembly is remounted on the combine.

19 Claims, 2 Drawing Sheets

COMBINE BLADE SHARPENING APPARATUS

BACKGROUND OF THE INVENTION

1. Field of the Invention

This invention relates to combine blades and sharpening apparatus therefor, and more particularly, to a sharpening apparatus having a plurality of spaced, progressively larger cutting wheels for cutting transverse slots in a combine blade for resharpening thereof.

2. Description of the Prior Art

Harvesting grain with a combine requires a moving cutting blade mounted on the forward side of the combine, and a variety of such cutting blades are known in the art. Generally, these blades have a generally rectangular body portion with a pair of angularly disposed cutting blades extending therefrom to form a substantially triangular forward cutting portion. The body portion is generally designed to be attached by rivets or the like to a long support bar which extends transversely to the blades and combine. A plurality of blades are attached side by side such that a row of V-shaped cutting notches are formed by the cutting edges of the blades.

One such blade is shown in U.S. Pat. No. 513,834 to Smith. Several cutting-edge configurations are disclosed in this patent, but basically each includes a plurality of scallops or serrations along tapered cutting edges.

U.S. Pat. No. 2,047,300 to Warner shows a blade having tapered cutting edges with serrations thereon which are substantially perpendicular to the direction of motion of the combine. This or a similar configuration is what is in frequent use at the present time.

Of course, all of these blades wear with use, and the cutting edges become dull and rounded. In the past, the blades are normally discarded because it has not been economical to resharpen them. In cases where the blades were resharpened, they normally had to be removed from the support bar and sharpened individually. This is undesirable because it is a time-consuming and expensive process.

The blade sharpening apparatus of the present invention provides a quick and easy way to resharpen combine blades while still mounted to the transverse support bar. This sharpening apparatus does not duplicate the previous cutting-edge configuration, but instead cuts a plurality of spaced, transversely extending slots therein. The sharpening apparatus of the present invention allows cutting edges of two adjacent blades to be sharpened at once with a plurality of spaced rotating cutting wheels. Previously known methods of manufacturing or sharpening combine blades have used stamping dies, such as in U.S. Pat. No. 3,128,644 to Forsyth et al., hammers as in U.S. Pat. No. 524,965 to Gindorff, or broaching blades as in U.S. Pat. No. 3,090,259 to Lang et al.

SUMMARY OF THE INVENTION

The combine blade sharpening apparatus of the present invention is adapted for resharpening the cutting edges of combine blades, which cutting edges are angularly disposed with respect to the direction of motion of the combine. The blade sharpening apparatus comprises a table adapted for receiving a plurality of blades to be sharpened, powered sharpening means such as a plurality of spaced cutting wheels of varying, and preferably progressively larger, size movable between a first, cutting position in which the cutting wheels cuttingly engage opposite cutting edges of a pair of adjacent blades on the table and a second, free position spaced from the blades, and a prime mover for driving the cutting wheels. Ordinarily, the blades are part of a blade assembly with the individual blades being attached to a transverse support bar. The cutting wheels when placed in the cutting position are adapted to cut a plurality of spaced, transverse slots in the blades extending from the cutting edges thereof.

The table preferably defines a V-shaped notch therein corresponding to the opposite, angularly disposed cutting edges of the pair of adjacent blades. The notch provides clearance for the powered sharpening means when in the cutting position. The table further preferably comprises guide means for receiving and guiding the transverse bar of the blade assembly such that the blades may be sequentially moved transversely along the table to a position for cutting. The guide means is preferably characterized by a pair of spaced, transversely extending guides attached to the table and adapted for slidably receiving the bar in a gap defined therebetween.

The blade sharpening apparatus further comprises adjustable table mounting or positioning means for transversely and longitudinally positioning the table with respect to the powered sharpening means. In the preferred embodiment, the apparatus includes a base, and the adjustable positioning means interconnects the table and base.

The cutting wheels are connected to the shaft of the prime mover by means such as a mandrel. The prime mover is mounted to a pivot frame which pivots about a stationary frame connected to the base. By pivoting the pivot frame, the cutting wheels on the prime mover may be moved between the cutting and free positions. The adjustable table mounting or positioning means allows precise alignment of the combine blade assembly attached to the table with respect to the cutting wheels.

Biasing means are provided for counterbalancing the pivot frame, prime mover and cutting wheels and further biasing the pivot frame toward the free position.

The blade sharpening apparatus is used to resharpen blades of a kind known in the art, and the result is a resharpened combine blade comprising a mounting portion having a rearward transverse side and a forwardly directed cutting portion integrally formed with the mounting portion and having a pair of cutting edges angling toward one another, the cutting edges having a portion angling outwardly from an upper surface to a lower surface thereof and defining a plurality of spaced transverse slots extending through the angled portion. Preferably, the slots are of substantially equal lengths.

It is an important object of the invention to provide a sharpening apparatus for sharpening blades of a combine blade assembly without prior disassembly thereof.

It is another object of the invention to provide a blade sharpening apparatus having a plurality of spaced cutting wheels of varying sizes adapted for cutting transverse slots in the cutting edges of combine blades.

Still another object of the invention is to provide a blade sharpening apparatus whereby a blade to be sharpened may be positioned transversely and longitudinally with respect to blade sharpening means.

Still another object of the invention is to provide a combine blade having transverse slots in the cutting edges thereof.

An additional object of the invention is to provide a method of sharpening a plurality of combine blades while the blades form a part of a blade assembly.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
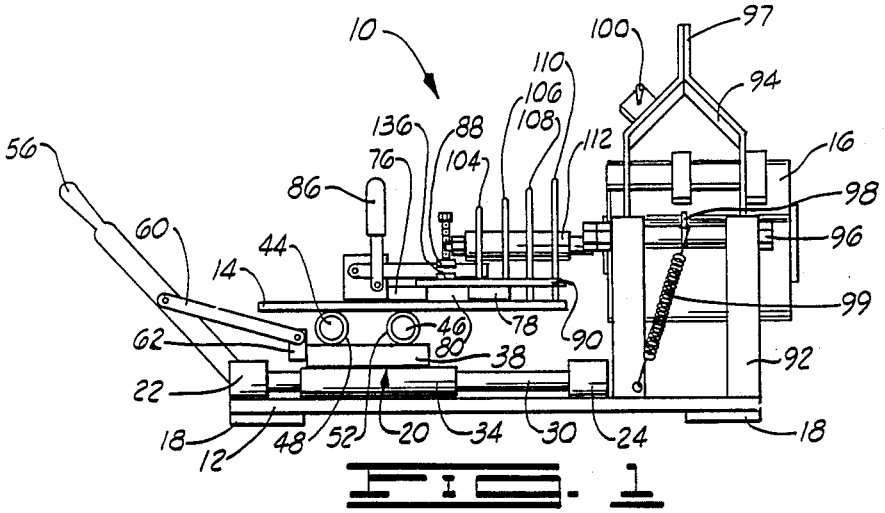
FIG. 1 is a longitudinal side view of the combine blade sharpening apparatus of the present invention.
Figure 2:
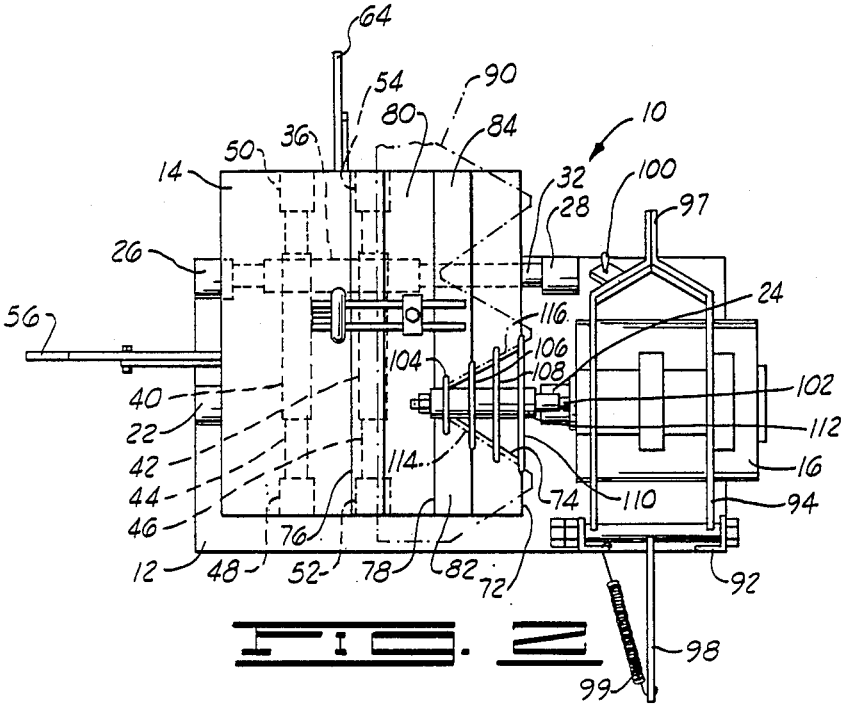
FIG. 2 is a top view of the combine blade sharpening apparatus.
Figure 3:
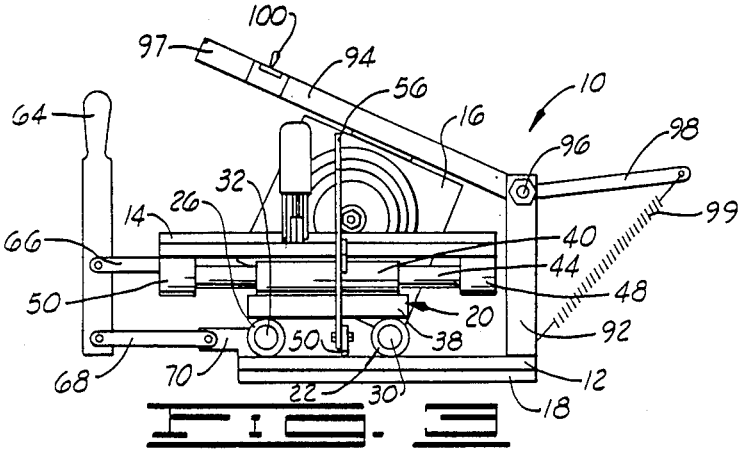
FIG. 3 is a transverse end view of the apparatus as seen from the left of FIGS. 1 and 2.

Referring now to the drawings, and more particularly to FIGS. 1-3, the combine blade sharpening apparatus of the present invention is shown and generally designated by the numeral 10. The major components are a substantially flat base 12, a table 14 upon which the combine blades to be sharpened are placed, and a prime mover such as electric motor 16, used to drive blade sharpening means.

Base 12 is essentially a flat plate of substantially rectilinear configuration and has support feet or pads 18 which extend downwardly therefrom. As shown in FIGS. 1 and 3, feet 18 extend transversely, but this is not critical.

Table 14 is connected to base 12 by an adjustable table mounting means 20. Adjustable table mounting means 20 is used for adjustably positioning the table in both transverse and longitudinal directions. A description of a preferred embodiment of adjustable table mounting means 20 follows, but other means for longitudinally and transversely adjusting the table would also be suitable.

Adjustable table mounting means 20 includes a first pair of longitudinally aligned collars 22 and 24 and a second pair of longitudinally aligned collars 26 and 28 transversely spaced from the first pair of longitudinal collars. Collars 22, 24, 26 and 28 are all fixedly attached to base 12, such as by welding. The opposite ends of a first longitudinal rod 30 are fixedly disposed in the first pair of longitudinally aligned collars 22 and 24, and rod 30 extends therebetween. The opposite ends of a similar, second longitudinal rod 32 are fixedly disposed in the second pair of longitudinally aligned collars 26 and 28, and rod 32 extends longitudinally therebetween.

Spaced, first and second longitudinal sleeves 34 and 36 are slidably disposed around first and second longitudinal rods 30 and 32, respectively. First sleeve 34 is positioned between collars 22 and 24, and second sleeve 36 is positioned between collars 26 and 28.

The upper sides of both first and second longitudinal sleeves 34 and 36 are fixedly attached to the lower side of a divider bracket 38. Fixedly attached to the upper side of divider bracket 38 are the lower sides of spaced, first and second transverse sleeves 40 and 42.

Slidably disposed within transverse sleeves 40 and 42 are first and second transverse rods 44 and 46, respectively. The opposite ends of first transverse rod 44 are fixedly disposed in a first pair of transversely aligned collars 48 and 50. The opposite ends of second transverse rod 46 are fixedly disposed in a second pair of transversely aligned collars 52 and 54 longitudinally spaced from the first pair of transverse collars. The top sides of collars 48, 50, 52 and 54 are fixedly attached to the lower side of table 14.

A first handle 56 is pivotally attached to base 12 at pivot point 58. One end of a link 60 is pivotally attached to an intermediate portion of lever 56, and the opposite end of link 60 is pivotally attached to divider bracket 38 at pivot point 62. It will be seen by those skilled in the art that by moving lever 56 in a longitudinally oriented plane, divider bracket 38, and thus table 14, may be moved longitudinally with respect to base 12. Thus, a first linkage means is provided for moving the table in the longitudinal direction.

An intermediate portion of a second lever 64 is pivotally connected to table 14 at pivot point 66. One end of a link 68 is pivotally attached to the lower end of lever 64, and the opposite end of link 68 is pivotally attached to base 12 at pivot point 70. It will be seen by those skilled in the art that, by moving lever 64 in a transversely oriented plane, table 14 may be moved transversely with respect to base 12. Thus, a second linkage means is provided for transversely moving table 14.

One transverse side 72 of table 14 has a substantially V-shaped notch 74 therein. A first transversely extending guide 76 is attached to the top of table 14 and spaced away from notch 74. A second transversely extending guide 78 is attached to the upper side of table 14 and is substantially parallel to first guide 76, such that a gap 80 is defined between guides 74 and 76. Notch 74 extends into guide 78 and divides it into a first portion 82 and a second portion 84.

A clamping means, such as clamping mechanism 86, of a kind known in the art, is attached to the top surface of table 14 adjacent guide 76. Clamping mechanism 86 includes a clamping portion 88 which is positioned generally above gap 80 between guides 76 and 78. Clamping mechanism 86 is used for clamping a combine blade assembly 90 to guides 76 and 78, and thus to table 14, as will be discussed in more detail hereinafter.

A stationary frame 92 is mounted on base 12 adjacent transverse side 72 of table 14. One end of a pivot frame 94 is pivotally attached to the upper end of stationary frame 92 at a pivot point 96. A distal end of pivot frame 94 forms a handle 97 by which pivot frame 94 may be rotated about pivot point 96. Motor 16 is mounted to an intermediate portion of pivot frame 94 in any manner known in the art.

An arm 98 extends from pivot frame 94 in a direction generally opposite to handle 97. In other words, arm 98 is positioned on an opposite side of stationary frame 92 from electric motor 16. An extension spring 99 interconnects the distal end of arm 98 with a lower portion of stationary frame 92. Thus, spring 99 provides a biasing means for counterbalancing pivot frame 94 and motor 16 and biasing pivot frame 94 toward a position spaced above table 14.

A switch 100 may be mounted to pivot frame 94 to control electric power to motor 16. Shaft 102 of motor 16 extends longitudinally toward table 14.

A plurality of grinding or cutting wheels, such as cutting wheels 104, 106, 108 and 110, are attached to output shaft 102 of motor 16 by means such as longitudinally disposed mandrel 112. Although four cutting wheels 104, 106, 108 and 110 are shown as the preferred embodiment, the number of wheels may be varied, and it is not intended that the invention be limited to four. The cutting wheels are spaced along mandrel 112 and are of varying sizes, and preferably of progressively larger size from the free end of mandrel 112 to the inboard end thereof adjacent motor 16. As illustrated in FIGS. 1–3, cutting wheels 104, 106, 108 and 110 are shown in a cutting position for cuttingly engaging a V-shaped notch or gap in blade assembly 90 defined between angled edges 114 and 116. By raising and lowering pivot frame 94, and thus motor 16, cutting wheels 104, 106, 108 and 110 may be alternately moved between the cutting position shown and a free position spaced above and away from blade assembly 90.

Figure 4:
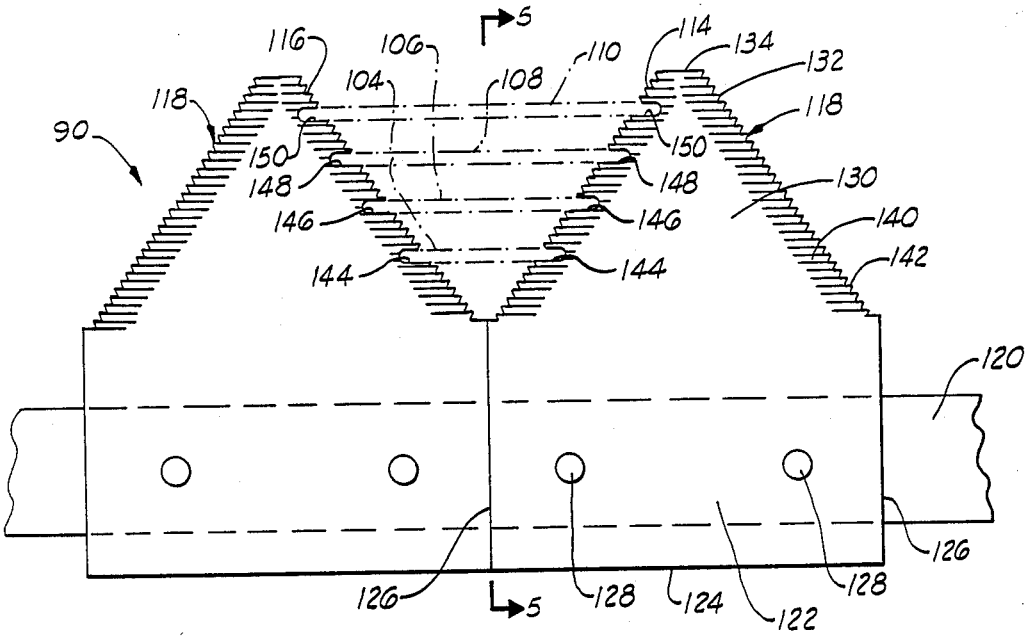
FIG. 4 illustrates a pair of combine blades attached to a support bar.

Referring now to FIG. 4, detail of the cutting action of cutting wheels 104, 106, 108 and 110 on opposite angled edges 114 and 116 of blade assembly 90 is shown. Blade assembly 90 comprises a plurality of individual combine blades 118 attached to a transverse support bar 120. Each blade 118 has a generally rectangular mounting portion 118 bounded in part by a rearward transverse side 124 and opposite longitudinal sides 126. Mounting portion 122 is attached to support bar 120 by any means known in the art such as rivets 128.

Extending from mounting portion 122 of blade 118 in an opposite direction from rearward transverse side 124 is a forwardly directed, generally triangular cutting portion 130. Cutting portion 130 of each blade 118 has a pair of cutting edges, such as indicated by numerals 114 and 132 for the blade shown on the right in FIG. 4. Cutting edges 114 and 132 angle toward one another toward the forward or leading end of blade 118. Cutting edges 114 and 132 preferably intersect a transverse leading edge 134.

Figure 5:
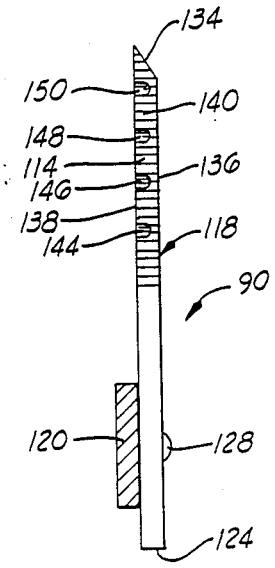
FIG. 5 is a cross section taken along lines 5—5 in FIG. 4.

Leading edge 134 tapers outwardly from top surface 136 to bottom surface 138 of blade 118, as shown in FIG. 5. Cutting edges 114 and 132 taper similarly from top surface 136 outwardly to bottom surface 138.

Each cutting edge 114 and 132, as originally provided from the manufacturer of blades 118, has a plurality of substantially V-notched serrations 140 therein which form a jagged cutting edge, as indicated by numeral 142. Serrations 140 usually extend transversely and thus are perpendicular to the direction of motion of the combine. The general shape of blade 118 and serrations 140 is well known in the art, and such a blade configuration has been effective for cutting grains. However, after a period of time, serrations 140 and jagged edge 142 become dull and are no longer effective. When this occurs, it is necessary to either replace or sharpen the blades. It is difficult if not impossible to resharpen the blades to their original condition without removing them individually from support bar 120, and normally this is not cost effective. The standard procedure is to simply replace the blades. The present invention solves this problem by providing a method for sharpening blades 118 while still attached to support bar 120. In other words, blade assembly 90 does not have to be dismantled.

When pivot frame 94 is moved downwardly such that cutting wheels 104, 106, 108 and 110 are in the cutting position already mentioned, the cutting wheels engage opposite cutting edges, such as 114 and 116, of a pair of adjacent blades 118. The diameters of cutting wheels 104, 106, 108 and 110 are progressively larger and are staggered at an angle approximately equal to the angle of cutting edges 114 and 116, as best shown in FIG. 4. Thus, cutting wheel 104 will cut a transverse slot 144 in both cutting edges 114 and 116. Similarly, cutting wheel 106 will cut slots 146, cutting wheel 108 will cut slots 148, and cutting wheel 110 will cut slots 150. By repeating this process, each of blades 118 as part of blade assembly 90 may be resharpened with slots 144, 146, 148 and 150 cut in each of the cutting edges thereof.

Testing has shown that the cutting edges with the slots formed therein will perform well for cutting grains, even though this is an entirely different configuration from original serrations 140 and jagged edge 142. Four slots has been found to be optimum, but more or fewer slots may be provided, depending upon the original blade configuration, blade size and the type of grain being cut.

When blade assembly 90 is placed on guides 76 and 78 on table 14, support bar 120 fits within gap 80 between the guides. Clamping mechanism 86 is placed in the clamping position shown in FIG. 1 in which clamping portion 88 engages top surface 136 of blade assembly 90. When clamped, blade assembly 90 is positioned such that edges 114 and 116 are essentially aligned with notch 74 in table 14. Table 14, and thus blade assembly 90 clamped thereto, may be moved longitudinally with respect to cutting wheels 104, 106, 108 and 110 by actuating lever 56 and moved transversely by actuating lever 64, as hereinbefore described. In this way, blade assembly 90 can be properly oriented with respect to cutting wheels 104, 106, 108 and 110 for the desired cutting of transverse slots 144, 146, 148 and 150.

Once one set of cutting edges 114 and 116 have had slots 144, 146, 148 and 150 cut therein, clamping mechanism 86 may be released and blade assembly 90 moved transversely so that a new set of cutting edges are aligned with notch 74 in table 14. The clamping and cutting procedure is then repeated. Thus, all of the cutting edges may be quickly and easily slotted without requiring disassembly of blade assembly 90.

It can be seen, therefore, that the combine blade sharpening apparatus of the present invention is well adapted to carry out the ends and advantages mentioned as well as those inherent therein. While a presently preferred embodiment of the sharpening apparatus and of a sharpened blade are shown for the purposes of this disclosure, numerous changes in the arrangement and construction of parts may be made by those skilled in the art. All such changes are encompassed within the scope and spirit of the appended claims.

What is claimed is:

1. A blade sharpening apparatus for combine blades having cutting edges which are angularly disposed to the direction of motion of a combine, said apparatus comprising:

a table having a surface for receiving a plurality of blades thereon to be sharpened;

a plurality of spaced cutting wheels of progressively larger size movable between a cutting position in which said wheels substantially simultaneously cuttingly engage opposite cutting edges of a pair of adjacent blades on said table such that transverse slots are cut in said blades and a free position spaced from said blades; and a prime mover for driving said cutting wheels.

2. The apparatus of claim 1 wherein said table defines a V-shaped notch therein corresponding to said opposite cutting edges of said pair of adjacent blades, said notch providing clearance for said cutting wheels when in said cutting position.

3. The apparatus of claim 1 wherein:

said blades are substantially flatly mounted to an elongated bar extending transversely to said blades; and said table comprises guide means for receiving and guiding said bar such that said blades may be sequentially moved transversely along said table to a position for cutting by said cutting wheels.

4. The apparatus of claim 3 wherein said guide means comprises a pair of spaced, transversely extending guides attached to said table such that said bar may be slidably received therebetween.

5. The apparatus of claim 1 further comprising adjustable positioning means for transversely and longitudinally positioning said table with respect to said cutting wheels.

6. A sharpening apparatus for combine blades of the type having angularly disposed cutting edges such that cutting edges of adjacent blades define a V-shaped gap therebetween, said apparatus comprising:

a table having a surface for receiving thereon a plurality of blades to be sharpened and defining a substantially V-shaped notch therein corresponding to said gap defined by said opposite cutting edges of said pair of adjacent blades; and powered sharpening means movable between a first position for sharpening said opposite cutting edges of said pair of adjacent blades, when said opposite cutting edges are positioned over said notch, by cutting slots in said blades, said notch providing clearance for said sharpening means, and a second position spaced from said table.

7. The apparatus of claim 6 wherein said sharpening means comprises:

a plurality of spaced grinding wheels movable against said blades for cutting a plurality of spaced, transverse slots in said opposite cutting edges during a cutting operation; and a prime mover for rotating said wheels.

8. The apparatus of claim 7 wherein said wheels of are progressively larger size.

9. The apparatus of claim 7 wherein:

said prime mover is an electric motor; and said wheels are attached to a shaft of said motor.

10. The apparatus of claim 7 further comprising adjustable positioning means for adjustably positioning said table in both transverse and longitudinal directions with respect to an axis of said wheels.

11. The apparatus of claim 6 wherein:

said blades are mounted to an elongated bar extending transversely thereto;

said table comprises guide means for receiving and guiding said bar such that said blades may be sequentially moved in a transverse direction along said table to a position aligned with said notch for sharpening by said wheels.

12. The apparatus of claim 11 wherein said guide means comprises a pair of spaced, transversely extending guides attached to said table such that said bar may be slidably received therebetween.

13. A combine blade sharpening apparatus for sharpening combine blades of the type mounted to a support bar and having cutting edges angularly disposed with respect to said bar, said apparatus comprising:

a base;

a table having a substantially V-shaped notch in a transverse side thereof;

a pair of transversely extending guides attached to said table and defining a gap therebetween for slidably receiving said support bar, one of said guides being separated into first and second portions by said notch in said table;

clamping means for clamping a plurality of bar mounted combine blades to said table and said guides;

adjustable table mounting means for adjustably mounting said table to said base such that said table may be moved transversely and longitudinally with respect to said base;

a stationary frame attached to said base adjacent said side of said table;

a pivot frame pivotally attached to said stationary frame and movable between first and second positions;

a prime mover attached to said pivot frame and movable therewith, said prime mover having an output shaft;

a plurality of spaced grinding wheels of varying sizes attached to said output shaft of said prime mover, said grinding wheels being in a cutting position for sharpeningly engaging opposite cutting edges of a pair of said blades adjacent said notch in said table and thereby cutting spaced slots therein when said pivot frame is in said first position, said grinding wheels being spaced above said blades when said pivot frame is in said second position.

14. The apparatus of claim 13 wherein said grinding wheels are of progressively larger size from a free end of said shaft to said prime mover.

15. The apparatus of claim 13 wherein said plurality of grinding wheels comprises four grinding wheels.

16. The apparatus of claim 13 wherein said clamping means comprises a clamp having a clamping portion which engages a top surface of said blades.

17. The apparatus of claim 13 wherein said adjustable table mounting means comprises:

spaced first and second pairs of longitudinally aligned collars fixedly attached to said base;

first and second longitudinal rods fixedly disposed in said first and second pairs of longitudinally aligned collars, respectively;

first and second longitudinal sleeves slidably disposed around said first and second rods, respectively, between the corresponding collars;

a divider bracket fixedly attached to said first and second longitudinal sleeves on an upper side thereof;

first and second spaced transverse sleeves fixedly attached to an upper side of said divider bracket;

first and second transverse rods slidably disposed in said first and second transverse sleeves, respectively;

first and second pairs of transversely aligned collars fixedly attached to said first and second transverse rods, respectively, and said table;

first linkage means connected to said base and said divider bracket for moving said divider bracket and table longitudinally with respect to said base; and second linkage means connected to said base and said table for moving said table transversely with respect to said divider bracket and said base.

18. The apparatus of claim 13 further comprising biasing means for counterbalancing said pivot frame, prime mover and said grinding wheels and further biasing said pivot frame toward said second position.

19. The apparatus of claim 18 wherein said biasing means is characterized by an extension spring attached to said base and a portion of said pivot frame on an opposite side of said stationary frame from said prime mover.

* * * * *